United States Patent [19]

Bittar et al.

[11] 4,299,309

[45] Nov. 10, 1981

[54] EMPTY ELEVATOR CAR DETERMINATION

[75] Inventors: Joseph Bittar, Simsbury, Conn.; J. Mark Deric, Johnson City, Tenn.

[73] Assignee: Otis Elevator Company, Hartford, Conn.

[21] Appl. No.: 107,672

[22] Filed: Dec. 27, 1979

[51] Int. Cl.[3] ..... B66B 3/00

[52] U.S. Cl. ..... 187/29 R

[58] Field of Search ..... 187/29

[56] References Cited

U.S. PATENT DOCUMENTS

| | | | |
|---|---|---|---|
| 2,776,733 | 1/1957 | Drexler | 187/29 |
| 3,219,151 | 11/1965 | Henker | 187/29 |
| 3,556,256 | 1/1971 | Sprague | 187/29 |
| 3,616,874 | 11/1971 | Stichweh et al. | 187/29 |

FOREIGN PATENT DOCUMENTS

| | | | |
|---|---|---|---|
| 1000878 | 11/1976 | Canada | 187/29 |

*Primary Examiner*—R. L. Moses

*Assistant Examiner*—W. E. Duncanson, Jr.

*Attorney, Agent, or Firm*—Robert E. Greenstien

[57] ABSTRACT

An elevator system includes a microprocessor-based cab controller mounted directly on an elevator car. The activity of passenger-actuatable switches within the elevator car, such as car call, open door, emergency stop switches, and the like, is monitored as an indication of the presence of passengers within the elevator car. Without such activity, the car is determined, preliminarily, to be empty. If the conditions exist for a period of time, the car is determined to be really empty, in a second level determination of the empty status of the car. The utilization of passenger load weight, along with passenger actuatable switch activity, is also disclosed as a determination of the empty status of the car. An exemplary elevator system, an exemplary microprocessor-based controller, and a logic flowchart illustrative of the details of the invention are disclosed herein.

6 Claims, 3 Drawing Figures

EMPTY ELEVATOR CAR DETERMINATION

DESCRIPTION

1. Technical Field

This invention relates to elevators, and more particularly to the determination of the presence of passengers in an elevator car.

2. Background Art

In elevator systems, it has long been known to provide some indication of the load weight in an elevator car, in order to tailor the car motion motor driving torque, in acceleration and deceleration, to the actual total weight of the car, and to assist in torque balancing as the elevator drive sheave brake is applied and/or released, for a smoother ride and minimum jerking from brake action. However, since safety is a paramount factor in elevator systems, it is desirable to provide the maximum possible passenger safety consistent with passenger convenience and the ability to handle heavy traffic, in elevator cars.

The load weighing systems known to the art are grossly inaccurate, being incapable of determining actual elevator car load weights to any accuracy greater than ±50 lbs. to ±150 lbs. Because of that fact, most load weighing systems known to the art are incapable of discerning the presence of a single passenger in an elevator car as a function of the weight indication provided thereby. And, because of that incapability, prior art elevator systems do not take into account actual passenger presence within the car in the safety-related operational control functions excerised over the car.

DISCLOSURE OF INVENTION

Objects of the invention include provision of safe determination of the presence of a passenger in an elevator car, and determination of the presence of a passenger in an elevator car without relying on load weight.

According to the present invention, the activity of passenger-actuatable switches within an elevator car, such as car call and door open buttons, is monitored as an indication of the presence of passengers within the elevator car. According further to the present invention, an indication of an elevator car being empty is provided with two levels of confidence, a first level being indicative of the lack of activity in the car, and a second level being indicative of the fact that the lack of activity has continued for an interval of time. In further accord with the present invention, an indication of the presence of a passenger in an elevator car is determined by a combination of passenger-actuatable switch activity and indicated car load, such as may be provided by a car duty/load weighing apparatus.

The present invention provides the capability of determining whether or not there are passengers in an elevator car, in nearly every instance, without taking into account any load weighing factor whatsoever. The invention also provides the capability of including load weight as an indicator of the presence of a passenger in the car, if desired. The invention may be implemented with a variable empty weight indication, which can be selected to suit the degree of confidence which is desired in the weight-indicated aspect of determining whether or not an elevator car is empty, when weight is considered.

By providing an empty determination having two levels of confidence, one being indicative of an apparent empty condition of the car, the other being indicative of the fact that the apparent empty condition has continued for a relatively long interval, the invention allows versatility in the utilization of the empty and really empty determinations of the present invention.

The present invention is readily implemented utilizing apparatus and techniques which are well within the skill of the art in the light of the specific teachings of the present invention described hereinafter.

The foregoing and other objects, features and advantages of the present invention will become more apparent in the light of the following detailed description of exemplary embodiments thereof, as illustrated in the accompanying drawings.

BEST MODE FOR CARRYING OUT THE INVENTION

Figure 1:
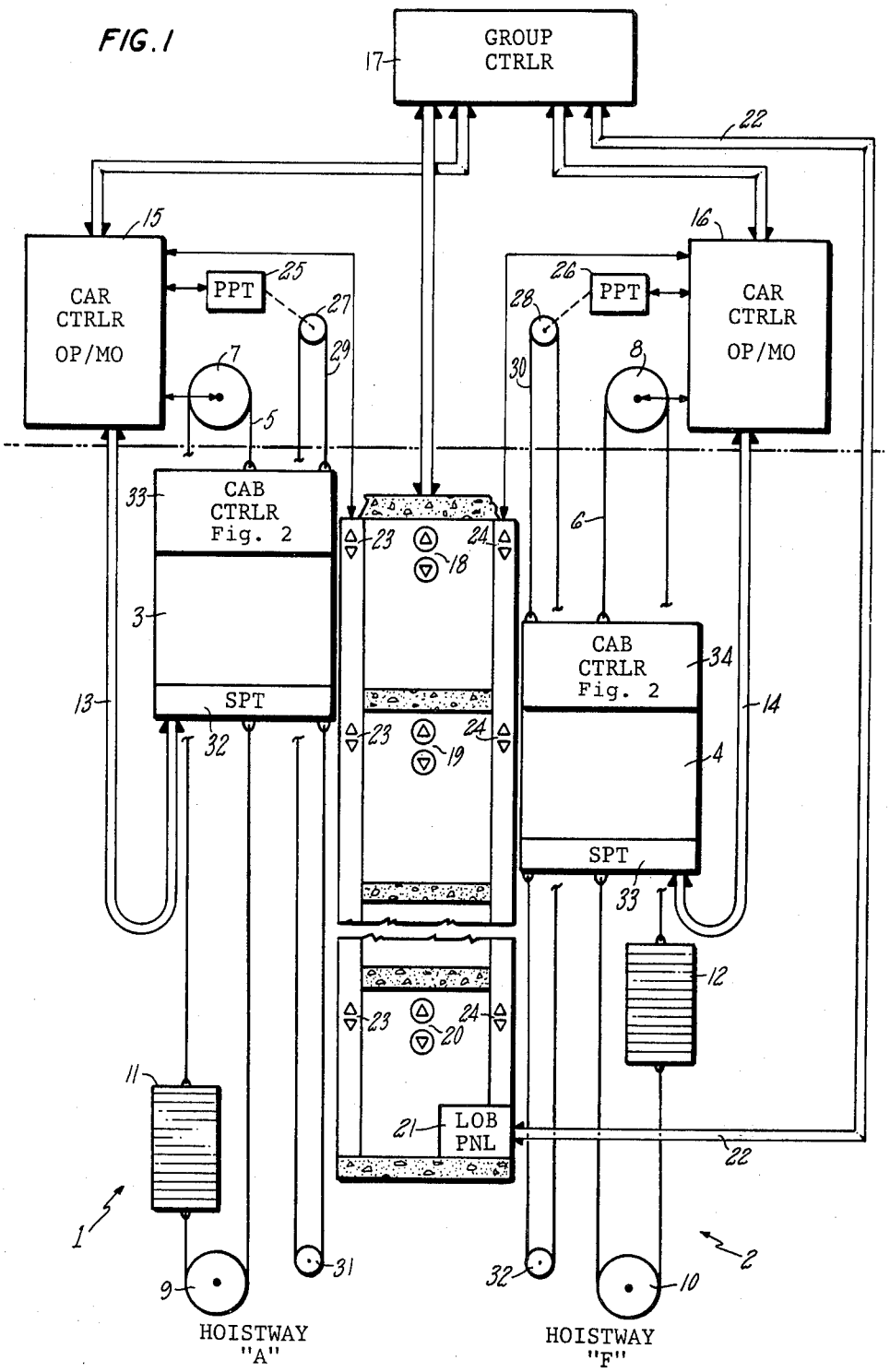
FIG. 1 is a simplified, schematic view of an elevator system in which the present invention may be practiced.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven either direction or held in a fixed position by a drive sheave/-motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissible load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasiabsolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for vertification of floor position information derived by the PPT 25, 26, may employ a secondary position transducer (SPT) 32, 33 of the type disclosed and claimed in a commonly owned copending U.S. application filed on Nov. 13, 1979 by Fairbrother, Ser. No. 093,475. Of, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself are directed, or communicated with, by means of a cab controller 33, 34 in accordance with the present invention, and may provide serial, time-multiplied communications with the car controller as well as direct, hard-wired communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor. The cab controller interfaces with load weighing transducers to provide weight information used in controlling the motion, operation, and door functions of the car. The load weighing may be in accordance with the invention described and claimed in commonly owned copending patent applications filed on Nov. 28, 1979 by Donofrio, Ser. No. 098,004 and by Games, Ser. No. 098,003. A most significant job of the cab controller 33, 34 is to control the opening and closing of the door, in accordance with demands therefore under conditions which are determined to be safe.

The makeup of microcomputer systems, such as may be used in the implementation of the car controllers 15, 16, a group controller 17, and the cab controllers 33, 34, can be selected readily available components or families thereof, in accordance with known technology as described in various commercial and technical publications. These include "An Introduction to Microcomputers, Volume II, Some Real Products" published in 1977 by Adam Osborne and Associates, Inc., Berkeley, Cal., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977–1978 Second Edition, published by Digital Equipment Corporation, Maynard, Massachusetts, U.S.A. And, Simpson, W. D., Luecke, G., Cannon, D. L., and Clemens, D. H., "9900 Family Systems Design and Data Book", 1978, published by Texas Instruments, Inc., Houston, Texas, U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming", in seven volumes, by the Addison-Wesley Publishing Company, Inc., Reading, Massachusetts, and Menlo Park, California, U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Division News), Boston, Massachusetts, U.S.A. And a useful work is Peatman, J. B., "Microcomputer-Based Design" published in 1977 by McGraw Hill Book Company (worldwide), U.S. Library of Congress Catalog No. 76-29345.

The software structures for implementing the present invention, and peripheral features which may be disclosed herein, may be organized in a wide variety of fashions. However, utilizing the Texas Instruments 9900 family, and suitable interface modules for working there with, an elevator control system of the type illustrated in FIG. 1, with separate controllers for the cabs, the cars, and the group, has been implemented utilizing real time interrupts, power on causing a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the control register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Figure 2:
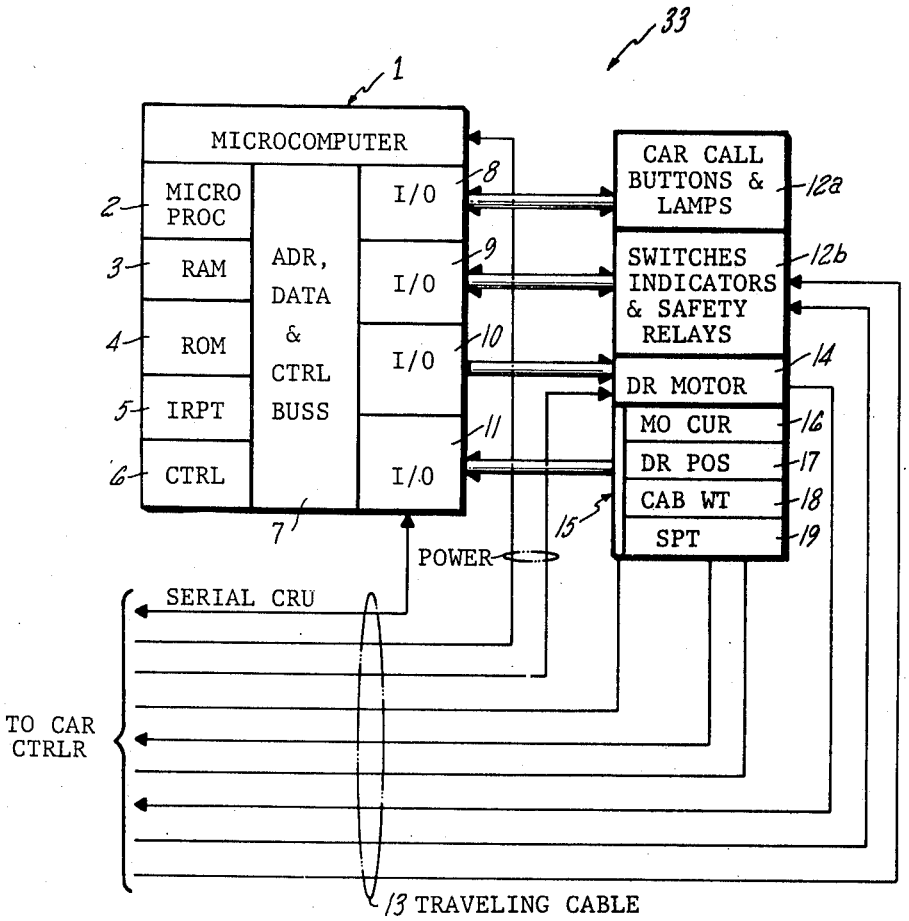
FIG. 2 is a simplified block diagram of an elevator cab controller which may be utilized in the elevator system of FIG. 1.

Referring now to FIG. 2, a cab controller 33 is illustrated simply, in a very general block form. The cab controller is based on a microcomputer 1 which may take any one of a number of well-known forms. For instance, it may be built up of selected integrated circuit chips offered by a variety of manufacturers in related series of integrated circuit chips, such as the Texas Instruments 9900 Family. Such a microcomputer 1 may typically include a microprocessor (a central control and arithmetic and logic unit) 2, such as a TMS 9900 with a TIM 9904 clock, random access memory 3, read only memory 4, an interrupt priority and/or decode circuit 5, and control circuits, such as address/operation decodes and the like. The microcomputer 1 is generally formed by assemblage of chips 2–6 on a board, with suitable plated or other wiring so as to provide adquate address, data, and control busses 7, which interconnect the chips 2–6 with a plurality of input/output (I/O) modules of a suitable variety 8–11. The nature of the I/O modules 8–11 depends on the functions which they are to control. It also depends, in each case, on the types of interfacing circuitry which may be utilized outboard therefrom, in controlling or monitoring the elevator apparatus to which the I/O is connected. For instance, the I/Os 8, 9 being connected to car control buttons and lamps 12*a* and to switches and indicators 12*b* may simply comprise buffered input and buffered output, multiplexer and demultiplexer, and voltage and/or power conversion and/or isolation so as to be able to sense car call button closure and to drive lamps with a suitable power, whether the power is supplied by the I/O or externally. Similarly, the I/O 9 may be required to cause a floor warning gong or an emergency buzzer to sound, to light indicators indicative of elevator operating mode, and to sense switches (such as an emergency power switch, or key switches for express operation and the like), and to operate and monitor door motor safety relays. On the other hand, the I/O 10 must either service an amplifier indicated as part of a door motor 14, or it must provide the amplification function. In such case, the I/O 10 may be specifically designed to be used as an I/O for a door motor 14; but if the door motor 14 includes its amplifier and monitoring circuitry, then a conventional data I/O 10 may be used. Similarly, an I/O 11 communicating with multi-functional circuitry 15, including door motor current feedback 16, a door position transducer 17, cab weight transducers 18, and a secondary position transducer 19 (which indicates the position of the car with respect to each floor landing) may be a general data I/O device if the functions are provided for in the circuitry 15, or it may be a specially-designed I/O device so as to perform necessary interfacing functions for the specific apparatus 16-19.

Communication between the cab controller 33 of FIG. 2 and a car controller (such as car controller 15 illustrated in FIG. 1) is by means of the well known traveling cable 13. However, because of the capability of the cab controller 33 and the car controller 15 to provide a serial data link between themselves, it is contemplated that serial, time division multiplexed communication, of the type which has been known in the art, will be used between the car and cab controllers. In such case, the serial communication between the cab controller 33 and the car controller 15 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired.

The traveling cable also provides necessary power to the microcomputer 1 as well as the door motor 14. For instance, ordinary 60 hz AC may be supplied to the microcomputer 1 so that its power supply can provide integrated circuit and transistor operating voltages to the various chips within the microcomputer 1, and separate DC, motor-operating power may be provided to the door motor 14. Other direct communications, such as between the secondary position transducer and the operation controller may be provided by hard-wiring in the traveling cable. Although not illustrated herein, additional wires for safety switches, power, and the like are also typically provided within the traveling cable. The desirability, however, of utilizing serial, time-division multiplex communications between the cab controller 33 and the car controller 15 is to reduce to two, the number of wires which may be necessary to handle as many as 200 discrete bits of information (such as car direction, request to open the door, car call registrations for particular floors, and the like). However, this forms no part of the present invention and is not described further herein.

In FIG. 2, the cab weight apparatus 18 may take the form of the apparatus disclosed and claimed in a commonly owned, copending U.S. patent application filed on Nov. 28, 1979 by Donofrio, Ser. No. 098,004. The transducer indication of the cab weight device 18 may be read into the microcomputer 1 (FIG. 2) by the I/O 11, and the signal indications therefrom processed in accordance with a load subroutine described and claimed in a commonly owned, copending U.S. patent application filed on Nov. 28, 1979 by Games, Ser. No. 098,003. However, as is described hereinafter, the invention need not employ any weight indication whatsoever, or it could employ other weight indications derived in different ways, if the teachings of said copending applications are not found desirable in any implementation of the present invention.

Within a program of instructions for performing various functions required on the elevator car, the microcomputer 1 may include a load routine 1 (FIG. 3), such as that described in the aforementioned application of Games, and then reach a car empty routine through a transfer point 2. The car empty routine may begin with a test 3 to compare new car calls read into the microcomputer 1 (FIG. 2) by the I/O device 8 from the devices 12, with previously read car calls, to determine if there is any car call button activity in each cycle. If there is activity, the comparison of all of the new car calls with all of the previously registered car calls, such as a bit-by-bit exclusive OR function, will yield a result which is indicated in test 3 as being negative (the old and the new car calls not being equal), and a step 4 will reset a car empty indication (which comprises the first level of car empty determination in accordance with the present invention). But if test 3 is affirmative, then a test 5 will compare any of the other passenger-actuatable switches (such as door open and door close buttons, a nonstop switch, an emergency stop switch, and the like), selected from the switches, indicators and safety relays 13 (FIG. 2), and provided to the microcomputer 1 through the I/O 9 (FIG. 2). If test 5 is negative, this indicates that the present cycle has sensed button activity or switch closures which are different than those previously recorded in a prior cycle, so test 5 will cause step 4 to reset the car empty determination.

Figure 3:
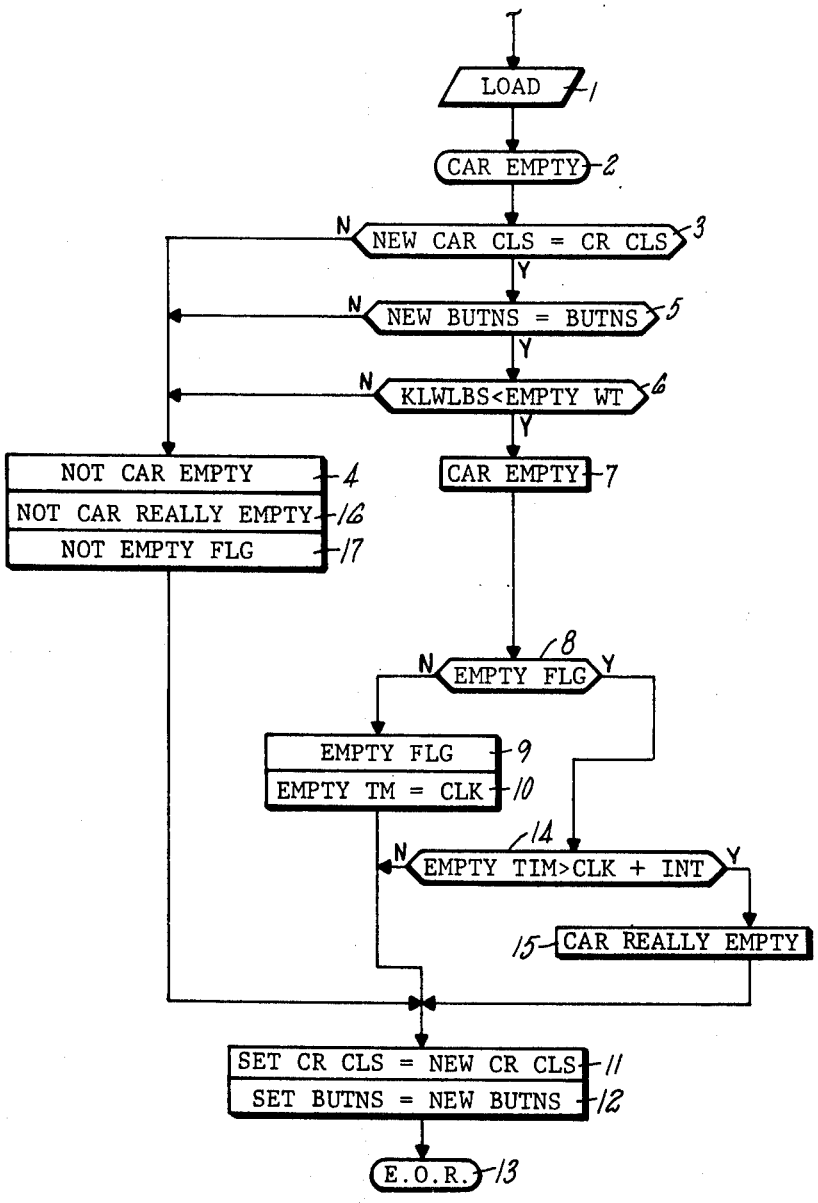
FIG. 3 is a simplified logic flow diagram of a car empty determination subroutine in accordance with the present invention.

In FIG. 3, if tests 3 and 5 are both affirmative, a test 6 may be employed, if desired in a given implementation of the invention, though not required for use of the invention in its broadest sense, to determine if the duty load weight, such as weight of passengers and their baggage in the elevator car, is less than some established threshold weight which is taken as an indication that these are passengers in the car. This weight may be selectively adjusted from zero, through the weight of a small child, to any weight within which the load weighing device may vary when the car is empty, in any given implementation of the invention. The designation of weight (KLWLBS) is a designation of actual load weight in the aforementioned copending applications of Donofrio and Games. If test 6 is negative, it will enable step 4 to reset the car empty determination.

In the event that all the tests 3, 5 and 6 are affirmative, meaning that there is no switch or button activity in the cab and there is no indication of passenger weight, then a step 7 will set the car empty indication. If step 7 is reached in any cycle of operation, a test 8 will determine whether an empty flag has been set in a step 9, which is a once-only type of flag. If not, the step 9 will set the empty flag and a step 10 will set an empty-time register to be equal to the time indicated by a suitable real time clock. And then a step 11 may cause the car calls indication to be updated to the new car calls indication and a step 12 may set the buttons indication to be equal to the new buttons indication, and the routine can be exited through an end of routine transfer point 13.

If desired, the comparison of new car calls with existing car calls and new buttons with existing button indications can be made in a communication processing subroutine of a normal type, and a flag of activity set, said flag being retained for use instead of the tests 3 and 5 in FIG. 3, and steps 11 and 12 can similarly be performed in such other subroutine. However, the particular order and manner in which these tests and steps are performed, in contrast with the other steps of FIG. 3, is irrelevant so long as the equivalent of step 3 and 5 are performed first in the subroutine of FIG. 3.

In FIG. 3, if test 8 is affirmative, meaning that the empty flag has previously been set, then a test 14 will determine whether the empty-time register exceeds the summation of the real time clock plus some preset interval. The interval determines the degree of confidence which is required before an affirmative result of test 14 will allow a step 15 to set a car really empty indication. As used in a commonly owned, copending U.S. patent application filed on even date herewith by Deric, Ser. No. 107,801 the interval is established as 5 minutes. However, this can be varied to suit any particular utilization of the present invention. It should be borne in mind in establishing the time interval of test 14, and the empty weight of the test 6, that considerations of safety may require the least possible empty weight and the longest possible time, in dependence upon how the indications of the car being empty and the car being really empty are to be utilized. Whenever test 14 is negative, the steps 11 and 12 will be reached and the program is exited.

Whenever tests 3, 5 and 6 (FIG. 3) are all negative and step 4 resets the car empty determination, a step 16 will reset the car really empty indication and a step 17 will reset the empty flag. Therefore, if there is a subsequent indication of the lack of button activity and the absence of weight in tests 3, 5 and 6, the entire time out process of tests and steps 7–9, 13 and 14 will begin anew, due to the flag being reset. This avoids any possibility of the car being determined to be empty in one cycle, not empty in a subsequent cycle, and really empty after the expiration of the interval (test 14) from the first cycle in which an empty indication was made. Thus there is a high level of confidence in the car really empty indication set in step 15.

As described briefly hereinbefore, the invention may be practiced without test 6 at all, but in most situations it is preferable to include test 6, with a suitably adjusted empty weight threshold established. The reason for this is that a handicapped person in a wheelchair might be unable to reach the buttons, or an ill person may faint and be unable to exercise concern over being in an elevator car. The inclusion of some weight in the determination may therefor be considered to be desirable in many applications of the present invention. However, if the invention is employed in an elevator car which is incapable of sufficiently accurate weight determinations as to continuously fail to recognize the empty status of the car, this test could be eliminated, if desired.

The particular buttons and switches which may be monitored by tests 3 and 5 (or equivalent tests), the weight used as a threshold for the indication of passengers within the car, and the time interval used for a second level of confidence are all variable to suit a given implementation of the present invention, and will normally vary from one elevator type to another, and from one installation to the next. The particular manner of performing the process, of which FIG. 3 is exemplary merely, can also be changed in a variety of ways while still taking advantage of the principal features of the invention, which are the utilization of button and/or switch activity in the cab to indicate that the cab is not empty, the use of an empty indication over a period of time for a greater level confidence in a really empty indication, and the use of such indications with a weight indication in determining whether or not the cab is empty.

Similarly, although the invention has been shown and described with respect to exemplary embodiments thereof, it should be understood by those skilled in the art that the foregoing and various other changes, omissions and additions may be made therein and thereto, without departing from the spirit and the scope of the invention.

We claim:

1. An elevator car movably disposed in a hoistway of a building for servicing a plurality of floor landings served by doors adjacent said hoistway, comprising:

passenger-actuatable switch means for registering demands for service by said car, and for providing demand signals indicative thereof; characterized by:

signal processing means operative in each of a series of repetitive cycles recurring several times per second for monitoring said demand signals and for storing, in each cycle, previous demand signals in response to said demand signals, for comparing said demand signals monitored in each cycle with said previous demand signals stored in a cycle next preceding such cycle, and for providing a car empty signal in th event that said demand signals of said one cycle are the same as said previous demand signals stored in the next preceding cycle.

2. An elevator car according to claim 1 further characterized by said signal processing means further comprising means for providing a signal indication of an interval of time within which said car empty signal is generated in each successive cycle of operation, for providing a signal indication of a predetermined interval, for comparing said time interval signal with said predetermined interval signal and providing a signal indication of a second level empty determination in response to said time interval being in excess of said predetermined interval.

3. An elevator car according to either of claims 1 or 2 further characterized by means for providing a car load signal responsive to the passenger load weight in said car; and said signal processing means further comprising means for providing a signal indication of a threshold passenger weight above which said car is considered not to be empty, and, in response to said threshold weight signal and said load weight signal, for providing said car empty signal in any cycle in which said threshold weight exceeds said passenger weight.

4. An elevator car according to either of claims 1 or 2 further characterized by said passenger-actuatable switch means including means for registering car calls indicative of floor landings at which passengers within the car desire the elevator to stop.

5. An elevator car according to either of claims 1 or 2 further characterized by said passenger-actuatable switch means including a door open switch for creating a door open command in said elevator car.

6. An elevator according to claim 1 or 2 further characterized by said passenger-actuatable switch means including emergency stop switch for providing a signal indicative of the fact that a passenger desires the elevator to stop.

* * * * *